United States Patent [19]

Seragnoli

[11] 4,319,861

[45] Mar. 16, 1982

[54] MAGAZINE-TYPE CIGARETTE FEEDING APPARATUSES FOR A CIGARETTE PACKAGING MACHINE

[75] Inventor: Enzo Seragnoli, Bologna, Italy

[73] Assignee: G.D Societa per Azioni, Bologna, Italy

[21] Appl. No.: 123,476

[22] Filed: Feb. 21, 1980

[30] Foreign Application Priority Data

Feb. 28, 1979 [IT] Italy ..... 3337 A/79

[51] Int. Cl.[3] ..... B65G 65/04

[52] U.S. Cl. ..... 414/419; 198/347; 198/857

[58] Field of Search ..... 414/425, 420, 421, 417, 414/419; 198/347, 857, 341, 577

[56] References Cited

U.S. PATENT DOCUMENTS

| | | | |
|---|---|---|---|
| 3,229,837 | 1/1966 | Schmermund | 414/419 |
| 3,486,647 | 12/1969 | Seragnoli | 414/419 |
| 3,550,799 | 12/1970 | Marradi | 414/421 |
| 3,598,268 | 8/1971 | Wallace | 414/421 |
| 3,939,984 | 2/1976 | Butner et al. | 198/341 |
| 4,085,759 | 4/1978 | Seragnoli | 198/347 |
| 4,134,486 | 1/1979 | Grove | 198/857 |
| 4,227,607 | 10/1980 | Malavenda | 198/577 |
| 4,236,604 | 12/1980 | Warner | 198/857 |

*Primary Examiner*—Lawrence J. Oresky

*Attorney, Agent, or Firm*—Fitzpatrick, Cella, Harper & Scinto

[57] ABSTRACT

Disclosed is an improved apparatus for feeding magazines of cigarettes to a cigarette packaging machine. The improvements reside in controls for synchronizing the delivery of full magazines to the packaging machine and also for monitoring the correct positioning of the magazines.

6 Claims, 6 Drawing Figures

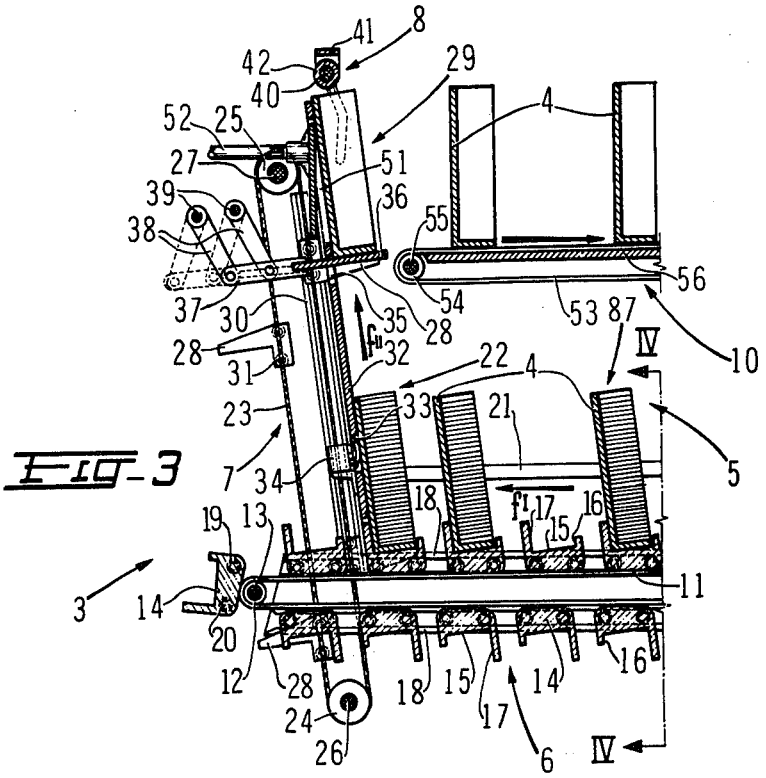
FIG-3
FIG-2
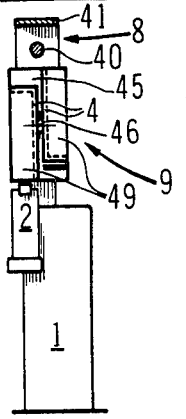
FIG-1
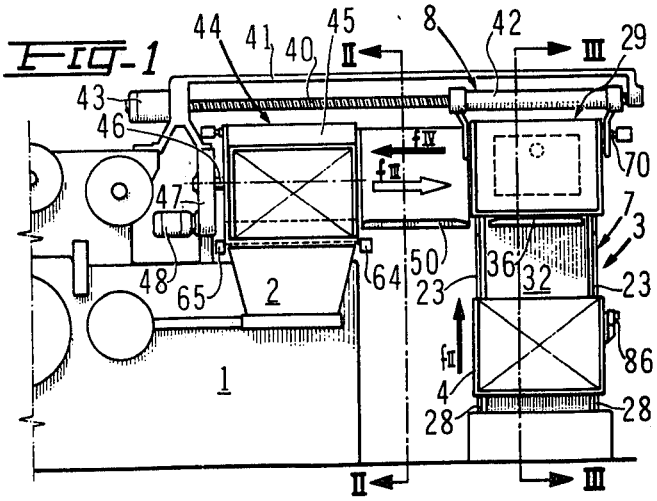

MAGAZINE-TYPE CIGARETTE FEEDING APPARATUSES FOR A CIGARETTE PACKAGING MACHINE

BACKGROUND OF THE INVENTION

This invention relates to improvements in or relating to the magazine-type cigarette feeding apparatuses for a cigarette packaging machine.

One of the known systems in use for feeding cigarettes from the manufacturing machine or machines to the packaging machine uses substantially parallelepiped rechargeable magazines.

The feeding operation according to this conventional system comprises in practice the following four stages: the placing of the cigarettes in said magazines by filling devices disposed at the exit of the manufacturing machines, the feeding of the full magazines to their zone of utilization, their emptying into the feed hopper of the packaging machine, and finally the transfer of the empty magazines back to the filling devices.

The improvements according to the invention aim at avoiding the stoppage of the packaging machine should the main conveyor of the feeding apparatus not supply full cigarette magazines with the required rate.

Magazine-type cigarette feeding apparatuses are known, for example, from the U.S. Pat. Nos. 3,229,837 and 3,298,549, from the German Pat. Nos. 1.157.534, 1.173.831 and 1.176.555 as well from the U.S. Pat. Nos. 3,486,647 and 4,085,759 in the name of the Applicant thereof.

Said known devices substantially comprise (a) an intermittently moved main conveyor for feeding full cigarette magazines from a loading position, wherein said magazines are manually or automatically loaded into seats provided on said main conveyor, to a withdrawal position, (b) intermittently moved elevator means for elevating said magazines from said withdrawal position to a transfer position overlying said main conveyor, (c) transfer means for transferring the magazines from said transfer position to an overturning position and (d) overturning means for emptying the cigarettes contained in said magazines into said hopper.

In said known apparatuses, the feeding of the cigarettes to the hopper is monitored by means sensitive to the level of the mass of cigarettes in the hopper independently from the possible absence of magazines in one or more seats of the main conveyor: it follows that the correct operation of said known apparatuses, i.e. the condition to be fulfilled so that a full cigarette magazine becomes emptied into the hopper during each cycle at the rate required by the packaging machine, is that a full cigarette magazine is present at the final end, or withdrawal position, of the main conveyor after each of its stepwise advancements.

If this condition is not fulfilled, i.e. if even a single magazine is not present in the withdrawal position, the drawback occurs of being compelled to stop the packaging machine.

A further drawback of the conventional apparatuses resides in the necessity of continuously checking the correct arrangement or disposition of the magazines in the seats of the main conveyor.

Any attempt to overcome the drawback due to the absence of magazines by manually inserting magazines into the empty seats of the intermittent main conveyor does not necessarily ensure success, as it presupposes the continuous presence and constant attention of an operator.

As an alternative to this system, i.e. if the empty seats are filled automatically, more complex and costly equipment is necessary, provided with bulky magazine buffer stores, as described for example in the already mentioned U.S. Pat. No. 4,085,759.

SUMMARY OF THE INVENTION

An object of the present invention is to provide improvements in or relating magazine-type cigarette feeding apparatuses so conceived to assure a continuous supply of full cigarette magazines to a packaging machine completely automatically at the rate required by the rate of said packaging machine, even if there is any discontinuity in the series of magazines inside the seats of the main conveyor: this enable to obviate or at least minimise one of the causes of stoppage of the packaging machine, and thus increase its production yield.

Another object of the invention is to provide improvements for detecting the presence of magazines not correctly positioned in the seats of the main conveyor and for automatically stopping the feeding apparatus without necessity of a constant and continuous checking by an operator.

According to the invention, the improvements in or relating to the magazine-type cigarette feeding apparatus for a cigarette packaging machine comprise detecting and monitoring means able to detect and monitor both the number of possible consecutive empty seats in the main conveyor and the arrangement of the magazines in said seats and synchronizing and operating means governed by said detecting and monitoring means to cause one or more successive stepwise advancement of the main conveyor depending on the absence of one or more magazines in the withdrawal position and to automatically stop the same main conveyor should a magazine be incorrectly positioned in the relative seat upstream of said withdrawal position.

More particularly in an apparatus for feeding cigarette magazines to a packaging machine of the type comprising a device for overturning said magazines inside the feed hopper of said packaging machine, means for monitoring the level of cigarettes inside said hopper for controlling said overturning device, an intermittent compartmented main conveyor for feeding said magazines to a so-called withdrawal position, and means for transferring individual full magazines from said withdrawal position to said overturning device and for transferring individual empty containers from said overturning device to a discharge position, the improvements comprising means, governed by said monitoring means, for synchronising and operating said transfer means, and means for detecting the presence of said magazines in said withdrawal position comprising control means for said intermittent main conveyor and activation means for said synchronising and operating means, said control means causing the drive means of said intermittent main conveyor to operate or cease to operate according to whether magazines are absent or present in said withdrawal position respectively, and said activation means blocking said synchronising and operating means if magazines are absent in said withdrawal position.

Further characteristic and advantages will be more apparent from the detailed description given hereinafter of a preferred but not exclusive embodiment of the improvements according to the invention, illustrated by way of non-limiting example in the accompanying drawings.

BRIEF DESCRIPTION OF THE DRAWINGS

FIG. 1 is a front view of magazine-type cigarette feeding apparatus embodying the improvements of the invention, the feeding apparatus being associated with a packaging machine only a part of which is diagrammatically shown;

FIG. 2 is a sectional side view through FIG. 1 on the line I—I;

FIG. 3 is a sectional side view of the feeding apparatus, to an enlarged scale, on the line III—III of FIG. 1;

DESCRIPTION OF THE PREFERRED EMBODIMENT

Figure 5:
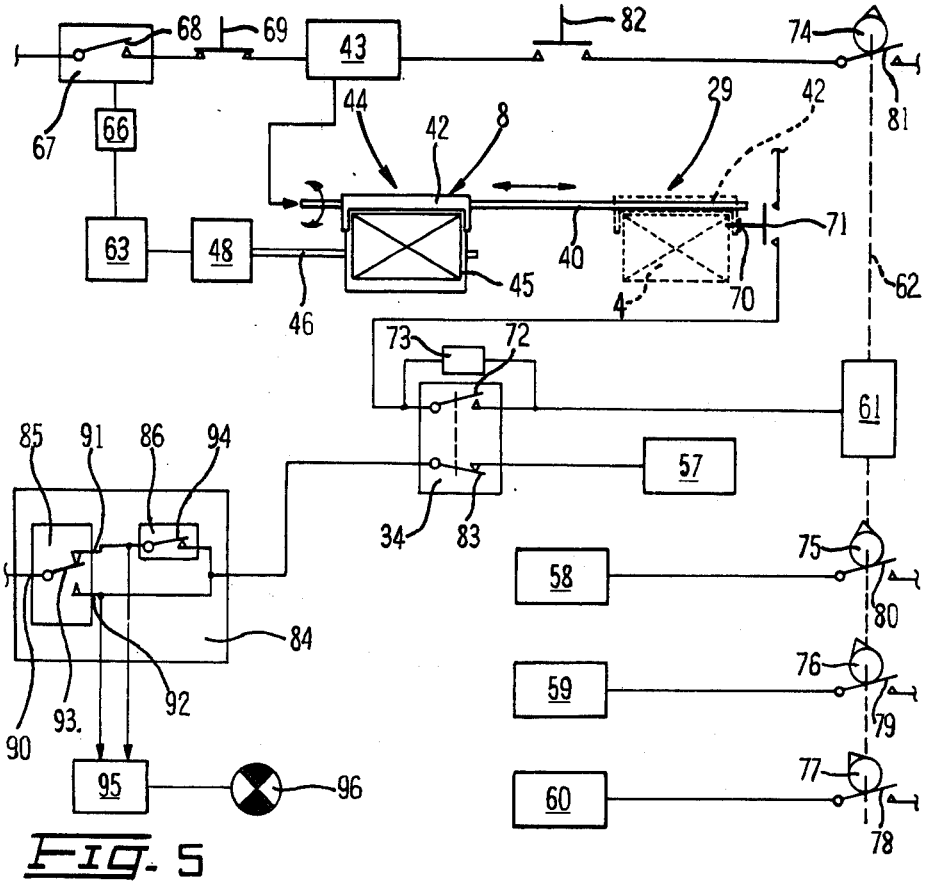
FIG. 5 is an electromechanical operating diagram for the improved apparatus according to the invention.

FIGS. 1 and 2 show a conventional cigarette packaging machine, indicated overall by the reference numeral 1. The inlet to this machine is constituted by a hopper 2, into which the cigarettes to be packaged are poured.

The reference numeral 3 (see also FIG. 3) indicates overall a conventional feeding apparatus embodying the improvements of the invention, the purpose of said feeding apparatus being to feed substantially parallelepiped magazines or containers 4 full of cigarettes 5 to the machine 1. The magazines 4, of known rechargeable type, have a width or transverse dimension which is substantially equal to the length of a cigarette, and are open upperly and on one of their side faces of greater size.

The feeding apparatus 3 is constituted by various members, these being, proceeding from upstream to downstream in the path direction followed by the magazines 4, a first horizontal conveyor 6, or main conveyor, an elevator 7 and a follower 8, an overturning device 9 and a second horizontal conveyor 10 or discharging conveyor, these members being di per se known and not making part of the invention.

The main conveyor 6, shown partly in FIG. 3, is disposed at a lower level than the hopper 2, and is constituted by an endless belt 11 passing around two pulleys 12 (only one of which is shown in FIG. 3), mounted on spindles 13.

At least one of the spindles 13 is driven (by a motor 57—FIG. 5—) with intermittent rotation in an anticlockwise direction, so that the upper branch of the belt 11 moves in the direction of the arrow f'.

Compartments or seats 14 are transversely fixed equidistantly to the belt 11, to receive, on the upper branch, magazines 4 full of cigarettes 5.

Said seats 14 are defined by a support base 15 inclined in a direction consistent with the direction f' of motion of the conveyor 6, and bounded upstream and downstream with respect to the direction of said motion by walls 16 and 17 normal to the base.

Figure 4:
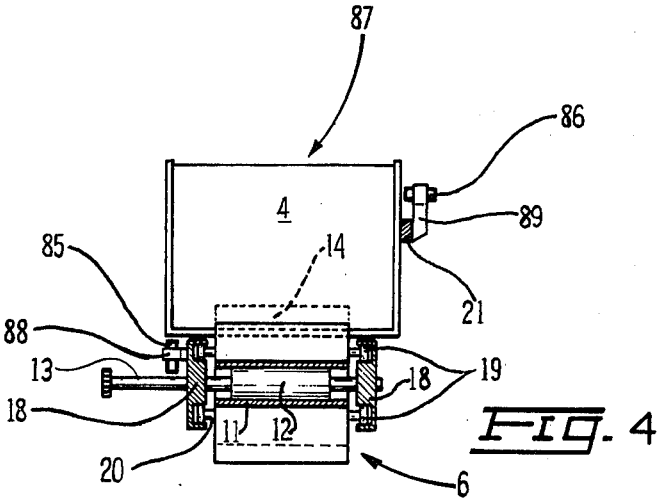
FIG. 4 is a section on the line IV—IV of FIG. 3.

The walls 16 and 17 are spaced apart by a distance substantially equal to the transverse dimension of said magazines 4, while the dimension of the seats 14 measured transversely to the belt 11 is less than the longitudinal dimension of the magazines 4 (see FIG. 4).

As shown in FIG. 3, the magazines 4 when in the seats 14 conventionally undergo an inclination which prevents the cigarettes escaping through the open face, opposite to direction f'.

The belt 11 advances at each step by the distance defined by two adjacent seats 14, and each of its branches is supported and guided by a pair of parallel fixed guides or rails 18, along which run idle rollers 19 mounted on spindles 20 parallel to the spindle 13 and rigid with said seats 14 (see FIGS. 3 and 4).

The reference numeral 21 indicates a contact and guide bar for the magazines 4 extending parallel to the fixed guides 18 and disposed in proximity to the upper branch of the belt 11, namely to the rear thereof when observing FIG. 3.

The condition for the perfect centering and thus correct arrangement of the containers 4 in their seats 14 is that the containers 4 are in contact with the bar 21, as shown in FIG. 4.

The elevator 7, disposed in the path of the conveyor 6 in proximity to its left hand end (FIG. 3) defines with this latter a position 22 known as the withdrawal position, in which the seats 14 halt temporarily in succession.

The elevator 7 comprises two chains 23 (only one of which is shown in FIG. 3) extending substantially parallel to the walls 16 and 17.

The chains 23 pass to the front and to the rear of the belt 11 (with reference to FIG. 3) and are endless about lower sprockets 24 and upper sprockets 25 mounted on spindles 26 and 27 respectively, both parallel to the spindles 13 and at least one of which is driven intermittently in an anticlockwise direction by a motor 58 (FIG. 5).

By virtue of this connection, the two right hand branches (with reference to FIG. 3) of the chains 23 move synchronously from the bottom upwards (arrow f'').

Four equidistant pairs of arms 28 are fixed to the chains 23 and extend substantially perpendicular to them, to constitute the lifting means for the magazines 4.

The elevator 7 is adjusted relative to the conveyor 6 such that after each forward movement, two arms 28 arrive in the withdrawal position 22 at the two ends of a seat 14, in alignment with its base 15, in order to engage with the two free end portions of the base of the magazines 4 (see FIGS. 1 and 3).

The distance between adjacent pairs of arms 28 is such that under said temporary halt conditions, a second pair of arms 28, adjacent to the preceding, is disposed in a position 29, known as the transfer position, substantially at the same level as said conveyor 10 and as the overturning device 9.

The ascending branches of the chains 23 are guided by two fixed guides or rails 30 parallel to them (see FIG. 3), along which run idle rollers 31 mounted on spindles parallel to the spindles 26, 27 and rigid with the arms 28.

The reference numeral 32 indicates a plate extending between the withdrawal position 22 and the transfer position 29. The plate 32, coplanar to the wall 17 of the seat 14 when temporarily halted in the position 22 and having the same transverse dimension as said wall 17, constitutes guide and slide means for the magazines 4 during their lifting.

In proximity to the lower end of the plate 32, there is provided an aperture 33 housing a device 34 for detecting the presence of magazines 4 in the withdrawal position 22.

In the transfer position 29, the plate 32 is provided close to its upper end with an aperture 35 which extends parallel to the spindle 27 of the sprocket 25.

At the aperture 35 there is provided a support plate 36 extending substantially perpendicular to the plate 32 and disposed between the two chains 23.

The plate 36 is rigid with the left hand end (with reference to FIG. 3) of a bar 37 connected by two connecting rods 38 to shafts 39 parallel to the spindle 27 and driven with swivel movement about their respective axes by a motor 60 (FIG. 5).

By means of the described connection, a to-and-fro movement through the aperture 35 is transmitted to the plate 36, between a working position in which it extends as a shelf at the position 29, and a position in which it is removed from the trajectory followed by the magazines 4 during their lifting.

The follower 8 comprises a threaded bar 40 supported by a frame 41 supported by the packaging machine 1 and extending parallel to the spindle 27 from a position overlying the elevator 7, to a position above the overturning device 9.

A fork 42 is mounted on the bar 40 and consists of an internally threaded tubular element provided at its ends with two arms extending downwards and spaced apart by a distance slightly greater than the longitudinal dimension of a magazine 4.

A motor 43 which can rotate in both directions is supported by the frame 41, and can rotate the bar 40 about its spindle in one direction or the other, with consequent transversing of the fork 42 between the position 29 and an overturning position 44 at the overturning device 9 (see FIGS. 1 and 3).

As can be seen from FIGS. 1 and 2, the overturning device 9 is of the type described in the already mentioned U.S. Pat. No. 3,486,647.

The overturning device 9 consists of a substantially parallelepiped head 45 mounted on a spindle 46 at its centre of gravity, parallel to the bar 40 and supported by an upright 47 rigid with the base of the machine 1. The spindle 46 is driven with intermittent rotations of 180° by a motor 48 supported by the upright 47.

The head 45 is divided into two compartments 49 disposed inversely symmetrical about an axial plane.

Under temporary halt conditions, one of the compartments 49 is disposed in the trajectory of the fork 42 in the position 44, while the second compartment 49 is disposed above the hopper 2.

The compartments 49 conventionally exchange their position for each 180° rotation of the head 45 by the motor 48.

A plate 50 substantially coplanar with the plate 36 acts as a connection element between the position 29 and the head 45.

A second aperture 51, at which a pusher 52 is provided, is formed in proximity to the upper end of the plate 32 above the aperture 35. The pusher is driven with horizontal reciprocating motion perpendicular to the bar 40, by a motor 59 (FIG. 5), between two extreme positions, namely a right hand limiting position above one end of the conveyor 10, and a left hand limiting position in which it is disengaged from the position 29 (see FIG. 3).

The purpose of said horizontal conveyor 10 is to remove the empty magazines 4 from the position 29, and is constituted by a continuously driven belt 53 passing around rollers 54 (only one of which is visible in FIG. 3) mounted on spindles 55 parallel to the spindle 27 and rotating clockwise.

The reference numeral 56 indicates a support plate for the upper branch of said conveyor 10.

In the operational description of the apparatus, reference will be made to the electromagnetic diagram of FIG. 5 and to the diagrams of FIG. 6 in addition to the already described FIGS. 1, 2, 3 and 4.

In addition to the motor 48 for the rotatable head 45 and the motor 43 for the follower 8, FIG. 5 also shows the motor 57 for the intermittent main conveyor 6, the motor 58 for the elevator 7, the motor 59 for the pusher 52, the motor 60 for the support plate 36, and a motor 61 for driving a shaft 62 (represented by a dashed line) on which a set of cams is keyed, and which will be described hereinafter.

The block 63 represents conventional monitoring means constituted by a photoelectric cell, comprising a photosensitive element 64 activated by a light source 65 which grazes the upper or inlet end of the hopper 2 (see also FIG. 1).

As already stated, the purpose of the photoelectric cell 63 is to trigger the various operations necessary to ensure feed continuity to the packaging machine 1, each time the level of cigarettes in the hopper 2 falls below a set value.

For this reason, the photoelectric cell 63 is directly connected to the motor 48 of the rotatable head 45, and connected via a delay element 66 to a remote switch 67 comprising a normally open contact 68 connected into a first supply line for the motor 43.

As shown diagrammatically in FIG. 5, if the motor 43 is supplied through the line comprising the contact 68 and a normally closed right limit contact 69 of fork 42 in series, its direction of rotation is such as to cause the fork 42 to move from position 44 to position 29 (see arrow f'' of FIG. 1).

A pushbutton 70 is provided in the transfer position 29. When the pushbutton 70 is pressed by the fork 42 in the right hand limiting position, it closes a normally open contact 71 connected in the supply line for the motor 61.

Activation means for the motor 61, consisting of a contact 72 forming part of the said detection device 34, are provided in this same line in series with the contact 71.

The contact 72 is open when there is no magazine in the position 22.

For reasons which will be apparent hereinafter, a self-excitation circuit comprising a remote switch 73 is connected into the supply line for the motor 61 in parallel with the contact 72. Four cams 74, 75, 76 and 77 are mounted on the shaft 62 of the motor 61, to form, together with their associated electrical contacts, the operating and synchronising means for the various component members of the apparatus, as is described in detail hereinafter with reference to the diagrams of FIG. 6.

In particular, a contact 78 connected into the supply line for the motor 60 is associated with the cam 77, a contact 79 connected into the supply line for the motor 59 is associated with the cam 76, and a contact 80 connected into the supply line for the motor 58 is associated with the cam 75.

Finally, a contact 81 connected into a second supply line for the motor 43 and in series with a normally closed left limit contact 82 of fork 42 is associated with the cam 74.

All said contacts are moved from a normal open position to a closed position by the respective cams.

The contours of the cams 75, 76 and 77 are such as to keep the three contacts 80, 79 and 78 closed for the entire operating cycle of the respective motors 58, 59 and 60, whereas the contour of the cam 74 is such that the contact 81 associated with it becomes closed and immediately reopened.

The motor 43 becomes supplied through said second line, with consequent movement of the fork 42 from the position 29 to the position 44 (see arrow $f^{IV}$ of FIG. 1) by a self-excitation circuit, not shown, as the result of a control signal imparted by the cam 74.

Control means for the conveyor 6, consisting of a contact 83 forming part of the detection device 34, are connected into the supply line for the motor 57.

In contrast to the contact 72, the contact 83 is closed when there is no magazine in the withdrawal position 22.

A device 84 for monitoring the presence and correct disposition of the containers 4 on the conveyor 6 is provided in series with the contact 83.

The device 84 comprises two sensors 85 and 86 disposed in the path of the conveyor 6 in a position 87 in which the seats 14 temporarily halt, this position being defined as the monitoring position (see also FIG. 4).

These sensors conveniently consist of capacitive proximity sensors able to provide a signal when the proximity of a material, even a non-metallic material, causes them to change their capacitance.

The sensor 85, supported by a bracket 88 rigid with one of the guides 18, is disposed in proximity to the path of the seats 14 at the level of their base 15, on the opposite side of the belt 11 to the bar 21.

The second sensor 86 is located on the opposite side of the belt 11 to the sensor 85 in proximity to the bar 21, and is supported on this latter by the bracket 89.

The sensor 85 is shown diagrammatically as a block provided with an input 90 connected to source for motor 57, and two outputs 91, 92.

It also comprises a contact 93 which connects said input 90 to said first output 91 if a magazine is present in position 87, or to the second output 92 if a magazine is absent in position 87.

The second output 92 is directly connected to the supply line for the motor 57, whereas the first output 91 is connected to said line through the sensor 86. This latter comprises a contact 94 which is closed if a magazine 4 is present and properly arranged in position 87, and is open, i.e. blocks the conveyor 6, if there is an empty seat 14 in position 87 or if a magazine 4 is not correctly arranged, i.e. is not in contact with the bar 21.

The reference numeral 95 represents a counter for the operational cycles undergone by the conveyor 6.

The counter 95 is connected both to the first output 91 and to the second output 92 of the sensor 85, such that it receives a signal which authorises it to count if the contact 93 is closed in its lower position, and a signal which causes it to zero if the contact 93 is closed in its upper position.

The counter 95 is connected to an alarm device 96.

Figure 6:
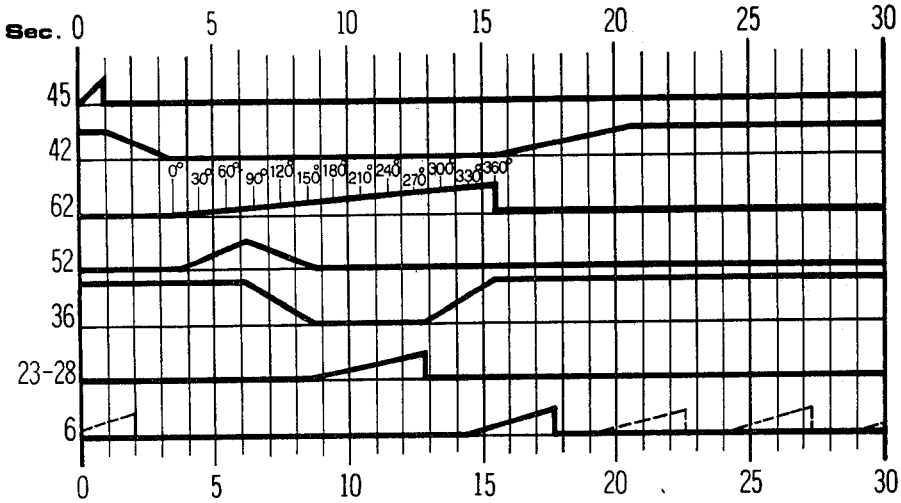
FIG. 6 shows the motion characteristics of significant parts of the improved apparatus according to the present invention, in the form of diagrams drawn on a common reference basis.

The diagrams of FIG. 6 show diagrammatically the temporary halts and movements of the more significant members of the apparatus according to the invention as a function of time expressed in seconds, during one operating cycle.

The duration of this cycle, equal to the time between two successive signals emitted by the photoelectric cell 63, i.e. the time required by the machine 1 to absorb the quantity of cigarettes in a magazine 4, has been assumed to be thirty seconds by way of example.

In the diagrams which relate to members moving with reciprocating or swivel movement, the horizontal portions represent halt times, the ascending portions represent outward movement times, and the descending portions represent return movement times.

In the diagrams relating to members which move with intermittent motion, the movement times are represented by ascending inclined portions, and the halt times by horizontal portions.

For greater clarity, these diagrams, which are shown as a function of time, also indicate a scale expressed in degrees of rotation representing the phase of movement of the cam shaft 62.

In this respect, the rotational cycle of the shaft 62 constitutes the reference basis for various members linked to this shaft by way of the synchronising cams 74, 75, 76 and 77.

The operation of the apparatus according to the invention will now be examined, starting from a situation in which the rotatable head 45 is under temporary halt, and is occupied by two magazines 4, one of which is being emptied into the hopper 2 and the other of which is full of cigarettes waiting to replace the preceding magazine in position 44.

In the diagrams of FIG. 6, this situation occurs in the time interval between the twenty first and thirtieth second.

The case will firstly be considered in which each seat 14 of the conveyor 6 is occupied by a magazine 4, including the seat in position 22.

It will also be assumed that all the magazines 4 are correctly arranged in their seats 15, in contact with the bar 21.

This latter supposition means that in the description given hereinafter, the monitoring device 84 can be ignored, and will instead be described later in detail.

At the moment in which the level of the mass of cigarettes in the hopper 2 falls below a predetermined value, the beam emitted by the light source 64 strikes the photosensitive element 65.

A control signal is then emitted by the photoelectric cell 63 for the motor 48 to rotate the rotatable head 45 through 180°, with consequent transfer of the magazine 4 full of cigarettes into its emptying position above the hopper 2, and the empty magazine into position 44 between the arms of the fork 42.

As can be seen from the diagrams of FIG. 6, this operation occurs within a time period of about one second.

The remote switch 67 is energised by the photoelectric cell 63 by way of the delay element 66, and its contact 68 closes the first supply line for the motor 43.

As stated, the rotation of the bar 40 by the motor 43 causes the fork 42 to move from left to right.

The empty magazine 4 is thus transferred by the rotatable head 45 to position 29 by way of the plate 50.

At the moment in which the container 4 arrives in this position 29 (between the third and fourth second from zero, i.e. from the beginning of the cycle), the plate 36 is temporarily at rest in its operating position, and the pusher 52 is withdrawn into its disengaged position, as can be deduced from the diagrams of FIG. 6.

At the moment in which the magazine 4 reaches position 29, the fork 42 stops the motor 43 by opening the limit contact 69, and at the same time closes the contact 71 by operating the pushbutton 70.

The closure of the contact 71 in series with the contact 72, which has already been closed because of the presence of a magazine 4 in the withdrawal position 22, causes the motor 61 to start, to rotate the shaft 62 on which the cams 74, 75, 76 and 77 are keyed.

Substantially coinciding with the beginning of the rotational cycle of the shaft 62, the cam 76 closes the supply line for the motor 59 of the pusher 52 by way of the contact 79.

The pusher slides through the aperture 51 in the plate 32 to engage the empty magazine 4 and pushes it to above the conveyor 10 by way of the plate 36.

At this point, the shaft 62 causes the cam 77 and contact 78 to close the supply line for the motor 60 which drives the plate 36. This withdraws to its disengaged position through the aperture 35, substantialy in synchronism with the return of the pusher 52 to its disengaged position.

At the conclusion of these operations, the elevator 7 is free to carry out its operating cycle, which begins as the cam 75 causes the contact 80 to close the supply line for the motor 58.

The magazine 4, which is at rest in position 22, is raised by the arms 28 until it becomes inserted between the arms of the fork 42 which is at rest in the transfer position 29.

The plate 36 then concludes its operating cycle under the control of the motor 60, by sliding through the aperture 35 and between the arms 28, to below the magazine 4.

Finally, at the end of the rotational cycle of the shaft 62, the cam 74 operates and closes the second supply line for the motor 43 by means of the contact 81.

From what has been stated heretofore, this causes the threaded bar 40 to rotate in such a direction as to move the fork 42 from the right to the left (narrow $f^{IV}$ of FIG. 1).

As the fork 42 moves away from position 29, there is an immediate interruption in the supply line to the motor 61 because of the reopening of the contact 71, and the shaft 62 and cams 74, 75, 76 and 77 thus stop.

The magazine 4 full of cigarettes between the arms of the fork 42 slides by way of the plate 50 to position 44 inside the rotatable head 45, at which the fork 42 stops the motor 43 by means of the limit contact 82.

The magazine 4 halts temporarily in position 44 while waiting to overturn its contents of cigarettes into the hopper 2 when the control signal for rotation is fed to the rotatable head 45 by the photoelectric cell 63, as previously stated.

As the container 4 full of cigarettes separates from the detection device 34 during transfer from position 22 to position 29, there is immediate opening of the contact 72 and closure of the contact 83.

This explains the presence of the self-excitation circuit comprising the remote switch 73, which ensures the conclusion of the rotational cycle of the shaft 62 in spite of aperture of the contact 72. The closure of the contact 83 causes the motor 57 to operate, and thus advance the conveyor 6 through one step.

Because of the assumption previously made, a new magazine 4 is then transferred to the withdrawal position 22 in contact with the plate 32 and detection element 34, which consequently opens its contact 83 and closes its contact 72.

This latter means that the motor 61 is ready to operate when the contact 71 is closed by the fork 42.

The case will now be considered in which not all the seats 14 of the conveyor 6 are occupied by a magazine 4, and the operation of the apparatus 3 will be examined starting with the transfer, from the withdrawal position 22 to position 29, of a magazine 4 (hereinafter called for convenience as the "last magazine") occupying a seat 14, which is followed by one or more empty seats.

When said last magazine moves away from the detection device 34, the contact 83 closes, resulting in supply to the motor 57 and thus the advancement of the conveyor 6 through one step. In these circumstances, in contrast to the previously discussed case, because there is no magazine 4 in the seat 14 reaching position 22, the supply line to the motor 57 does not become interrupted by the detection means 34.

The conveyor 6 therefore passes through a second step, to transfer the next seat 14 to the withdrawal position 22.

Generally, it can therefore be concluded that the conveyor 6 advances with intermittent motion at the rate determined by its drive means until a magazine 4 reaches the withdrawal position 22, to interrupt supply to the motor 57 by opening the contact 83.

During the stepwise advancement of the conveyor 6, said last magazine 4 reaches the rotatable head 45 in the described manner, and when controlled by the photoelectric cell 63 is overturned over the hopper 2, so exchanging its position with the position of an empty magazine.

When the follower 8 is controlled by the photoelectric cell 63, it transfers the empty magazine 4 to position 29.

As stated, in position 29 the fork 42 closes the contact 71 for controlling supply to the motor 61.

At this point there are two possibilities. If a new magazine has reached the withdrawal position 22 in the time period between the elevator 7 has transferred said last magazine to position 29 and the moment in which the empty magazine reached position 29, then the contact 72 will also be closed and the shaft 62 will begin its normal rotational cycle, assuring the feeding of a new magazine 4 to the rotatable head 45 prior of the rotation control signal emitted by the photoelectric cell 63.

From the diagrams of FIG. 6, it can be seen that during this time interval (approximately 20 seconds) the conveyor 6 is able to carry out four steps, at the rate of advancement transmitted to it by its intermittent drive means. This means that the apparatus embodying the improvements according to the invention is able to ensure feed continuity to the packaging machine provided the number of consecutive empty seats does not exceed three.

However, if after this time interval the withdrawal position 22 is occupied by an empty seat 14, the contact 72 remains open and blocks the various members served by the cams 74, 75, 76 and 77.

The members of the apparatus remain at rest, with the exclusion of the conveyor 6, until a new magazine 4 reaches position 22. When this occurs, the rotational cycle of the shaft 62 begins.

By means of the cams 74, 75, 76 and 77, this controls the various apparatus members for transferring the magazine 4 from position 22 to position 44 inside the rotatable head.

At this point, the behaviour of the packaging machine 1 will be considered in the case in which when said last magazine has been emptied, i.e. approximately thirty seconds after its overturning in the hopper 2, a new full magazine has not yet reached position 44 inside the rotatable head 45.

Under these circumstances, the photoelectric cell 63, which maintains its energised state even after the 180° rotation of the rotatable head 45, stops the motor of the packaging machine 1 by known means.

This latter then restarts, either automatically or by manual operation, after the arrival of a new magazine full of cigarettes, as it is overturned inside the hopper 2.

From the aforegoing description, it is apparent that the improvements according to the present invention attains their objects by eliminating stoppages of the packaging machine 1 due to any discontinuity in the feed of magazines 4 to the withdrawal position 22, provided the number of consecutive empty seats in the conveyor 6 does not exceed a determined value.

This result is obtained by separating the drive means for the intermittent conveyor 6 from the control and synchronisation means for the various members of the apparatus.

Moreover, the number of consecutive empty seats compatible with regular operation of the packaging machine 1 reaches its maximum value, for constant frequency and drive speed of the conveyor 6, when the time for transferring individual magazines from position 22 to their discharge position in the hopper 2 is reduced to a minimum.

For this reason, it has been found particularly advantageous in practice for the apparatus to use an overturning device consisting of a rotatable head of the characteristics stated heretofore.

The monitoring device 84 will now be considered.

If the magazines 4 are correctly disposed in contact with the bar 21, then even if any magazines 4 are absent, the device 84 has its input and output constantly connected together, independent of the position assumed by the contact 93, and consequently does not interfere with the normal operation of the motor 57.

If the magazine 4 is not centered in its seat 14 when in position 87, i.e. is separated from the bar 21, the sensor 86, in contrast to the sensor 85 (see FIG. 4), does not detect its presence, and opens the contact 94 to block the motor 57.

As already stated, the capacitive sensor 85 feeds either a counting control signal or a zeroing control signal to the counter 95, in the respective absence or presence of a magazine in position 87. When the number of successive missing magazines approaches the number which will cause the packaging machine 1 to stop, the counter 95 operates the alarm 96, which can be of visual or acoustic type.

In the described embodiment, the alarm 96 is operated if the monitoring device 84 detects three consecutive empty seats.

If necessary, the operator can then insert one or more magazines in order to reduce the number of consecutive empty seats to a number such as not to prejudice the operational continuity of the packaging machine 1. In the described case, this number must be less than four.

What I claim is:

1. In an apparatus for feeding cigarette magazines to a packaging machine comprising a device for overturning said magazines inside the feed hopper of said packaging machine, a monitoring device for monitoring the level of cigarettes inside said hopper for controlling said overturning device, an intermittent main compartmented conveyor for feeding said magazines to a withdrawal position, and transfer units for transferring individual full magazines from said withdrawal position to said overturning device and individual empty magazines from said overturning device to a magazine discharging conveyor, the improvements comprising synchronising and operating members, governed by said monitoring device, for synchronising and operating said transfer units and a detecting element for detecting the presence of said magazines in said withdrawal position comprising a control member for said intermittent main conveyor and an activation member for said synchronising and operating members, said control member causing the drive motor of said intermittent main conveyor to operate or to cease to operate according to whether magazines are absent or present in said withdrawal position respectively, and said activation member blocking said synchronising and operating members if magazines are absent in said withdrawal position.

2. An apparatus according to claim 1, wherein said synchronising and operating members for said transfer units comprise cyclic elements rigidily connected together and contact elements under the control of said cyclic elements for controlling the drive motors of said transfer units.

3. An apparatus according to claim 1, wherein a monitoring device is provided in a so-called monitoring position in the path of said intermittent main conveyor, said monitoring device comprising a first sensor for monitoring the presence of individual magazines in the seats of said main conveyor, and a second sensor for monitoring the correct arrangement of said magazines in said seats, said monitoring device being in series connected to said control member of the drive motor of the main conveyor and comprising a blocking element of said drive motor governed by said second sensor.

4. An apparatus according to claim 3, wherein a counter is provided for counting the steps of said intermittent main conveyor, a control element for said counter governed by said first sensor, and an alarm device governed by said counter, said control element causing said counter to count if a magazine is absent in said monitoring position, and zeroing said counter if a magazine is present in said monitoring position.

5. An apparatus according to claim 3, wherein said first and second sensors are capacitive proximity sensors.

6. In an apparatus according to claim 5, of the type comprising an intermittently moved main conveyor for feeding full cigarette magazines from a loading position, wherein said magazines are manually or automatically loaded into successive seats or compartments provided on said main conveyor, to a withdrawal position, an intermittently moved elevator for lifting said magazines from said withdrawal position to a transfer position overlying said main conveyor, transfer units for transferring individual full magazines from said transfer position to an overturning position wherein the cigarettes are emptied into the hopper and for transferring individual empty magazines from said overturning position to a magazine discharging conveyor and an overturning device in said overturning position, the improvements comprising support members for the magazines provided in said transfer position, said support members being subjected to a to-and-fro movement between an inoperative position disengaged from said elevator and an operative position for supporting full containers fed from said withdrawal position and empty containers fed from said overturning device, a pusher member in said transfer position also subjected to a to-and-fro movement in a direction transversal to the direction of said elevator to pass from an inoperative position disengaged from the same elevator to an operative position in which it engages empty magazines coming from said overturning device for pushing the same onto said magazine discharging conveyor.

* * * * *